US005097768A

United States Patent [19]

Petrovich

[11] Patent Number: 5,097,768

[45] Date of Patent: Mar. 24, 1992

[54] PETALLING PROJECTILE

[76] Inventor: Paul A. Petrovich, 11269 Judd Rd., Fowlerville, Mich. 48836

[21] Appl. No.: 668,290

[22] Filed: Mar. 11, 1991

[51] Int. Cl.[5] ..... F42B 12/34

[52] U.S. Cl. ..... 102/510

[58] Field of Search ..... 102/507, 508, 509, 510, 102/516, 517, 518

[56] References Cited

U.S. PATENT DOCUMENTS 1,094,395 4/1914 VanKampen et al. ..... 102/510

1,681,295 8/1928 Johnson ..... 102/509

*Primary Examiner*—Charles T. Jordan

*Attorney, Agent, or Firm*—Peter A. Taucher; David L. Kuhn

[57] ABSTRACT

The invention is a firearms projectile having an improved petalling action upon impacting a target. The projectile includes a slug whose head is separated into petalling elements by fins of a softer material than that of the slug, the head defining a central recess from which the fins radiate. The slug has a core therein which is forwardly and rearwardly tapered and is configured to assist the outward movement of the petalling elements after the projectile impacts. The cylindrical walls of the projectile provide a limited, controlled degree of longitudinal support to the petalling elements and the projectile includes means to force the cylindrical walls outward and away from the petalling elements once impact begins.

20 Claims, 1 Drawing Sheet

PETALLING PROJECTILE

GOVERNMENT USE

The invention described herein may be manufactured, used and licensed by or for the U.S. Government for governmental purposes without payment to me of any royalty thereon.

BACKGROUND AND SUMMARY

There exist today numerous kinds of projectiles used by law enforcement agencies for hand guns carried by their personnel. Frequently, a design purpose of such projectiles is to maximize their ability to stop an assailant despite the projectiles' typically small caliber. These projectiles spread outward, or petal, when they penetrate a human target. This petalling maximizes the bodily damage to a would-be assailant and thereby maximizes the probability that such an assailant will be stopped.

Applicant's projectile is of the general class which petals upon penetration. However, applicant's projectile is unique because of features which control its rate of expansion relative to the rate of penetration. These features include a head separated into petalling elements by fins softer than the material of the head and a jacket whose longitudinal support of the petalling elements can be varied to change petalling rate. The configuration of the interface between the jacket wall and the petalling elements can also be varied to modifiy the relative rates of petalling and penetration.

DETAILED DESCRIPTION

Figure 1:
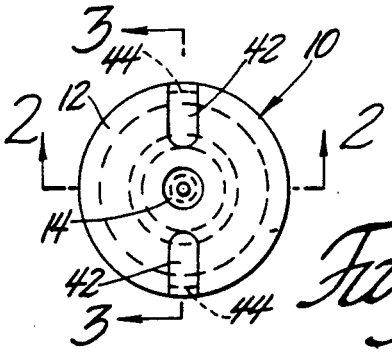
FIG. 1 is a top elevational view of a first embodiment of my projectile.
Figure 2:
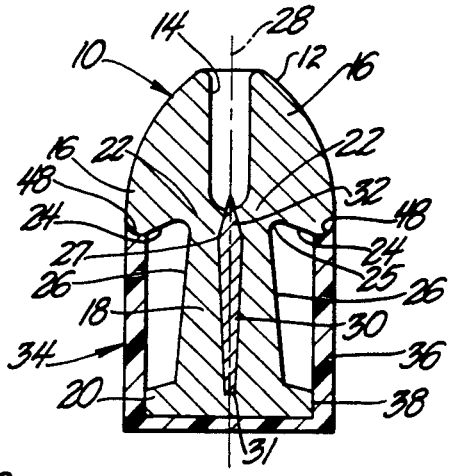
FIG. 2 is a view taken along line 2—2 in FIG. 1.
Figure 3:
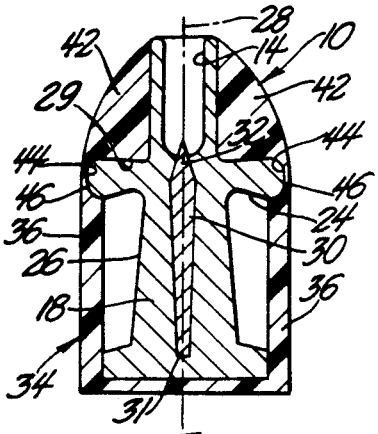
FIG. 3 is a sectional view taken along line 3—3 in FIG. 1.

FIGS. 1, 2 and 3 shown the first embodiment of a bilaterally symmetric projectile 10 having a hollow point slug 12 defining a blind, generally cylindrical recess 14 which flares outward at the open, forward end. Slug 12 has a head divided into two identical petalling elements 16 supported on a shank 18 and has a base 20 connected to the head by the shank. Slug 12 is made of a relatively soft metal such as lead. Petalling elements 16 are connected to shank 18 by a neck 22 between recess 14 and the corner formed by a junction 25 of exterior surface 26 of shank 18 and undercut shoulder 24 on the axially rearward face of the petalling elements. The radial distance between junction 25 and the outer periphery of projectile 10 is between one-half and two-thirds of the projectile's radius that would be extended from axis 28 through the junction. In FIG. 2, shoulder 24 slants radially outward and rearward, toward base 20.

Embedded within slug 12 along longitudinal axis 28 thereof is an elongate core 30 extending from base 20 through shank 18 to the blind end of cylindrical recess 14. Core 30 has a forward point or ose 32 which may be at the blind end of recess 14 without extending into the recess, or point 32 may protrude slightly into the recess as shown in FIG. 2. Core 30 is formed of a material harder than that of slug 12, the core being formed, for example, of a ceramic or of tungsten coated with ceramic material.

Core 30 is preferably symmetric with respect to axis 28 and has a radially thickest portion or waist 27 at the rear of point 32. Core 30 tapers both forwardly and rearwardly from its waist, the rearward taper being more gradual than the forward taper. It is also preferred that the portion of core 30 to the rear of the waist be at least 3 times the length of the core forward of the radially thickest portion. It is intended that the forward taper of point 32 will have an effect on petalling elements 16 when projectile 10 strikes a target. Upon striking a target, slug 12 will flatten and petalling elements 16 will fold outward or "petal" like petals of an opening flower. The petalling elements will have a rearward component of motion relative to core 30. The forward taper on core 30 will bear against neck 22 to assist radially outward separation of petalling elements 16. The waist of core 30 has a smaller diameter than cylindrical recess 14 so that petalling elements 16 will not interfere with core 30 once core 30 passes through neck 22.

The rearward taper on core 30 allows the inertia of shank 18 and base 20 to be at least partially transferred to core 30 as projectile 10 arrives at the target, whereby the penetrating ability of the core is enhanced. The rearward end of core 30 may have a flat, axially facing surface bearing against the base, as at 31, to maximize the ability of base 20 to transfer momentum to core 30. Under most circumstances, especially when projectile 10 strikes flesh, it is likely that slug 12 will completely peel or petal away from core 30 and core 30 will continue into the target with only its own inertia. The elongate shape of core 30 maximizes the post-petalling mass behind the point and enhances the core's ability to penetrate independently.

Projectile 10 also has a jacket 34 of a low friction plastic such as nylon or polytetrafluorethylene that is preferably at least as soft as the material of slug 12. Jacket 34 forms a cup around shank 18 and base 20 by means of cylindrical wall 36 and base wall 38. Jacket 34 defines with slug 12 an empty toroidal chamber. The cup of jacket 34 closely fits about base 20 of the projectile at base wall 38, and this cup also forms a smooth exterior of projectile 10 where it meets with petalling element 16 as seen in FIG. 2. Continuous with the cup, jacket 34 has fins 42 oriented radially in the head of projectile 10 between petalling elements 16, the fins preferably filling the space between the petalling elements as shown in FIG. 1. Jacket 12 has thin wall extensions 46 at inset surfaces 44 of slug 12 which connect fins 42 to the cup. The purposes of the fins are to prevent petalling elements 16 from catching on elements of an automatic loading mechanism when individual rounds are chambered in a gun and to improve the aerodynamics of projectile 10. The rearward edge of one of the fins is shown at 29 in FIG. 3.

Cylindrical wall 36 provides a controlled degree of longitudinal support to petalling elements 16, the longitudinal strength of these walls optionally being enhanced by their radial thickness or by the use of reinforcing inserts or fibers. If greater penetration of the projectile is desired relative to the rate and degree of petalling, then wall 36 is made stronger so as to increasingly retard the folding back of the petalling elements. The interface 48 between cylindrical wall 36 and petalling elements 16 is cross sectionally shaped like a shallow cup open along a longitudinally forward, radially inward direction, whereby rearward pivoting of petalling elements 16 will tend to force wall 36 radially outward and reduce the walls ability to longitudinally support the petalling elements after the initial stage of petalling has occurred. The exact shape of interface 48 is chosen to affect the quickness with which wall 36 is forced outward by the petalling elements, and in particular the opening of the cup cross section of interface 48 can be oriented more radially inwardly to increase that quickness. It is possible for the cup cross section to be a very shallow curvature or even a straight line so long as the average slope of the interface slants forward in the radially outward direction.

Figure 4:
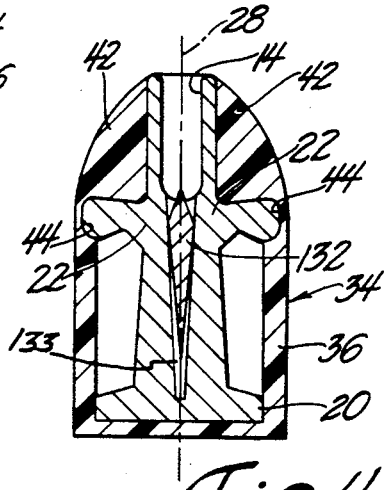
FIG. 4 is a cross sectional view of a second embodiment of my projectile.

FIG. 4 shows a cross section of second embodiment of of the projectile which is the same as FIG. 3 except that core 132 in FIG. 4 replaces core 32 in FIG. 3 and core 132 is press fit within an elongate rearwardly tapered hole 133. Hole 133 extends from within base 20 to cylindrical recess 14 and opens into that recess. The diameter of hole 133 where it meets the recess should be no less than the greatest diameter of core 132. Core 132 may be pointed at both ends as shown in FIG. 4, or core 132 may have a flat rearward surface like that of core 32 bearing axially against the bottom of hole 133. It may also be desired that core 132 otherwise be the same shape as core 32. The advantage of the FIG. 4 embodiment is the ease during its manufacture of inserting core 132 into hole 133.

Figure 5:
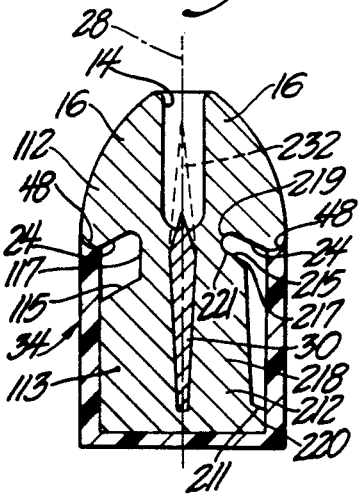
FIG. 5 is a composite cross sectional view showing a third and a fourth embodiment of my projectile, the third embodiment shown to the left of the center line in the figure and the fourth embodiment being shown on the right side of the center line.

FIG. 5 is an analog to FIG. 2 and is used to depict modifications that may be made to the first embodiment. The left side of FIG. 5 shows a first modification wherein slug 112 replaces slug 12. The intermediate diameter zone 113 of slug 12 is behind petalling elements 16 and forms a majority of the mass of slug 112 behind those elements. Zone 113 is radially larger than smallest diameter zone 117 but is radially smaller than petalling elements 16. Intermediate diameter zone 113 has an outer cylindrical periphery that bears against the inner periphery of wall 34. Zone 113 has a sloped forward face 115 that is oriented forwardly and somewhat radially outwardly. Shoulder 24, face 117 and smallest diameter zone 117 together form an annular groove about slug 112. The objective of the left-side FIG. 5 design is to provide a petalling projectile having greater average density than the first embodiment of the projectile, which is shown in FIGS. 1 through 3.

The right side of FIG. 5 shows another modification that may be made to the projectile wherein slug 212 has a base 220 fit closely within the cup of jacket 34 connected to shank 218. Shank 218 begins at bevel 211 at the rear of the projectile and extends forward to point 217 at the opening of annular groove 215. Point 217 is preferably between one-third and one-half the radial distance between bend 219 at the radially inward end of groove 215 and interface 48 as seen in the right side of FIG. 5. When the projectile strikes the target and petalling elements pivot rearward, the rearward face of the petalling elements will engage points 217. Petalling elements 16 will then tend to pivot about points 217 while being longitudinally reinforced by surface 221, whereby the rate of petalling is retarded relative to projectile penetration rate after petalling elements 16 contact points 217. Shank 218 has a greater average radius than shank 18 of shown in FIG. 2. The right-side FIG. 5 embodiment of the projectile will therefore have a greater average density than the first embodiment of the projectile and will also have a greater penetration rate relative to the rate of petalling.

FIG. 5 also shows in dashed lines an optional extended point 232 for core 30.

Figure 7:
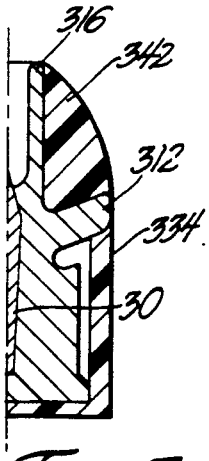
FIG. 7 is a second cross sectional view of the sixth embodiment, the FIG. 7 view being taken along line 7—7 in FIG. 6. Only the right side of the projectile is shown in FIG. 7, it being understood that the left side of the projectile is a mirror image of the right side.
Figure 6:
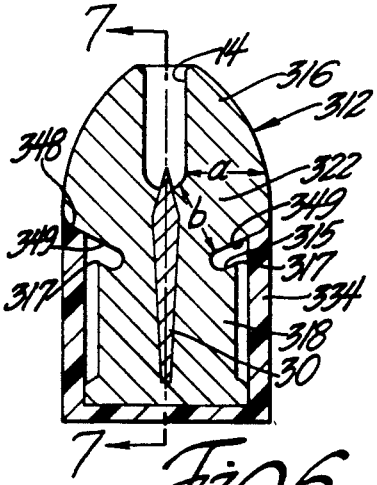
FIG. 6 is cross sectional view of a sixth embodiment of my projectile.

FIGS. 6 and 7 show still another embodiment of my projectile having a slug 312 with petalling elements 316 separated by plastic fins 342 and connected to a shank 318 by means of a transition zone 322, which is thicker and stronger than the analogous necks shown in the slugs of previous embodiments of the projectile. The thickness "b" of zone 322 between cylindrical recess 14 and surface 349 should be no less than the radial width "a" at the boundary zone where the petalling elements adjoin neck transition zone 322. Half jacket 334 is essentially a cup enclosing the rear half of the projectile and is preferably made of a soft, malleable metal such as copper or brass. Half jacket 34 is nonetheless somewhat harder than slug 312, which is preferably made of lead. Slug 312 defines an annular groove 315 between petalling elements 316 and shank 318, groove 315 being slanted radially outward in the forward direction. Point 317 at the opening of groove 315 is opposed by lower surface 349 of petalling element 316, and after the petalling elements pivot rearward to point 317, then the petalling elements tend to pivot around point 317. As petalling elements 316 pivot rearward, they force wall 334 outward because of interface 348 between these elements and wall 334. Since wall 334 is made of a relatively soft, malleable metal, the walls will tend to petal out away from shank 318 to create a secondary petalling of the projectile.

Figure 8:
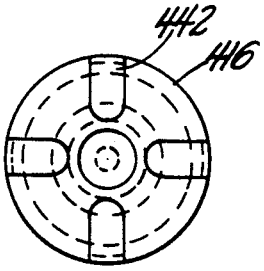
FIG. 8 top elevational view of an optional modification of my projectile.

FIG. 8 illustrates a still a further possible modification to the first embodiment of the projectile. The FIG. 8 embodiment is the same as the first embodiment except that the FIG. 8 jacket has four fins 442 and four petalling elements 416 as opposed to two fins and petalling elements of the first embodiment. It is believed that any number of fins and petalling elements could be provided on the projectile, the greater number of fins and petalling elements increasing the rate of petalling relative to the projectile's rate of penetration.

I wish it to be understood that I do not desire to be limited to the exact details of construction shown and described herein since obvious modifications will occur to those skilled in the relevant arts without departing from the spirit and scope of the following claims.

I claim:

1. A projectile having an improved petalling action upon striking a target, comprising:

a forward end;

a rearward end;

a slug having a head at the forward end comprised of petalling elements and having a generally cylindrical recess along a longitudinal axis of the projectile, the slug having a base at the rearward end connected to a shank and necks connecting the petalling elements to the shank;

an elongate core within the slug aligned along the longitudinal axis;

a waist on the core, the core defining a nose forward of the waist, a side of the nose bearingly interfacing with the necks;

wherein the core tapers rearwardly from the waist and the waist is smaller in diameter than the cylindrical recess;

a flat, axially rearwardly facing surface on the core bearing against a complimentary surface within the base;

a jacket comprising a cylindrical wall about the slug, the cylindrical wall longitudinally supporting the petalling elements;

means for forcing the forwardmost portion of the cylindrical wall radially outward when the projectile impacts with a target, the forcing means comprised of an interface between the cylinder wall and the petalling elements, the interface having an average slope such that the interface is slanted generally forward in the radially outward direction;

fins between the petalling elements, the radially outer surface of the fins being flush with the outer peripheral surface of the petalling elements.

2. The projectile of claim 1 wherein:

the slug defines an annular groove between the petalling elements and the shank;

posterior surfaces on the petalling elements face in a rearward, radially inward direction;

a shoulder on the shank faces in the forward, radially outward direction and opposes the posterior surfaces, the shoulder and posterior surfaces forming opposed sidewalls of the annular groove;

the shank extends radially outward to the cylindrical wall.

3. The projectile of claim 1 wherein:

the slug defines an annular groove between the petalling elements and the shank;

posterior surfaces on the petalling elements face in a rearward direction;

a shoulder on the shank faces in a forward direction and opposes to the posterior surfaces, the shoulder and posterior surfaces forming opposed sidewalls of the annular groove;

the shank and core together occupy the majority of the distance from the longitudinal axis to an inner peripheral surface of the cylindrical wall, whereby the cylindrical wall and the shank define a narrow, axially elongate toroidal gap therebetween.

4. The projectile of claim 1 wherein:

the shank defines an elongate, rearwardly tapered hole therein communicating with the cylindrical recess; and the core is press fit in the hole.

5. The projectile of claim 1 wherein:

the slug defines an annular groove between the petalling elements and the shank;

posterior surfaces on the petalling elements face in a rearward direction;

a shoulder on the shank faces in a forward direction and opposes to the posterior surfaces, the shoulder and posterior surfaces forming opposed sidewalls of the annular groove;

the slug has a circular edge at the outer periphery of the shoulder, the edge opposed by the posterior surfaces.

6. The projectile of claim 5 wherein one-half to two-thirds of the posterior surface is radially outward of the edge.

7. The projectile of claim 3 wherein a radial cross section of the annular groove slants in a radially outward, axially rearward direction.

8. The projectile of claim 3 wherein a radial cross section of the annular groove slants in a radially outward, axially forward direction.

9. The projectile of claim 8 wherein:

the slug has boundary zones where the petalling elements meet the necks;

the distance from the cylindrical recess to the posterior surface is at least as great as the radial width of the boundary zones.

10. A projectile having an improved petalling action upon striking a target, comprising:

a forward end;

a rearward end;

a slug having a head at the forward end comprised of petalling elements, the slug having a generally cylindrical recess along a longitudinal axis of the projectile, a base at the rearward end connected to a shank and necks connecting the petalling elements to the shank;

an elongated core within the slug aligned along the longitudinal axis;

a jacket comprising a cylindrical wall about the slug;

fins integral with the cylindrical wall disposed between the petalling elements;

wherein the fins are softer than the petalling elements and the radially outer surfaces of the fins are flush with outer peripheral surfaces of the petalling elements.

11. The projectile of claim 10 including means for forcing a forwardmost portion of the cylindrical wall radially outward upon the projectile's impact with a target.

12. The projectile of claim 11 wherein the forcing means is comprised of an interface between the cylinder wall and the petalling elements, the interface having an average slope such that the interface is slanted generally forward in the radially outward direction.

13. The projectile of claim 10 further comprising:

an elongate core within the slug aligned along the longitudinal axis; and a waist on the core;

a nose on the core forward of the waist, a side of the nose contacting the necks.

14. The projectile of claim 13 wherein the core tapers rearwardly from the waist and the waist has a smaller diameter than a maximum diameter of the cylindrical recess.

15. The projectile of claim 10 wherein:

the slug defines an annular groove between the petalling elements and the shank;

posterior surfaces on the petalling elements face in a rearward, radially inward direction;

a shoulder on the shank faces in the forward, radially outward direction and opposes the posterior surfaces, the shoulder and posterior surfaces forming opposed sidewalls of the annular groove.

16. The projectile of claim 15 wherein the slug has a circular edge at the outer periphery of the shoulder, the edge opposed by the posterior surface.

17. The projectile of claim 16 wherein one-half to two-thirds of the posterior surface is radially outward of the edge.

18. The projectile of claim 10 wherein:

the slug has a boundary zone where the petalling elements meet the necks;

the distance from the cylindrical recess to the posterior surface is at least as great as the radial width of the boundary zones.

19. The projectile of claim 18 wherein a radial cross section of the annular groove slants in a radially outward, axially forward direction.

20. A projectile having an improved petalling action upon striking a target, comprising:

a forward end;

a rearward end;

a slug having a head at the forward end comprised of petalling elements, the slug having a generally cylindrical recess along a longitudinal axis of the projectile, a base at the rearward end connected to a shank and necks connecting the petalling elements to the shank;

an elongate core within the slug aligned along the longitudinal axis;

fins disposed between the petalling elements;

wherein the fins are softer than the petalling elements and the radially outer surfaces of the fins are flush with outer peripheral surfaces of the petalling elements.

* * * * *